US006648022B2

(12) United States Patent
Pentz et al.

(10) Patent No.: US 6,648,022 B2
(45) **Date of Patent: *Nov. 18, 2003**

(54) LOOSE-FILL INSULATION DISPENSING APPARATUS INCLUDING SPIKED CONDUIT LINER

(75) Inventors: Edward Pentz, Boyertown, PA (US); David M. Kawano, Fresno, CA (US)

(73) Assignee: CertainTeed Corporation, Valley Forge, PA (US)

( * ) Notice: Subject to any disclaimer, the term of this patent is extended or adjusted under 35 U.S.C. 154(b) by 123 days.

This patent is subject to a terminal disclaimer.

(21) Appl. No.: 09/948,471

(22) Filed: Sep. 21, 2001

(65) Prior Publication Data

US 2003/0057142 A1 Mar. 27, 2003

(51) Int. Cl.[7] ..... F16L 55/18
(52) U.S. Cl. ..... 138/37; 138/39; 239/590.3
(58) Field of Search ..... 138/39, 37; 239/590, 239/590.3, 590.5

(56) References Cited

U.S. PATENT DOCUMENTS

| | | | | |
|---|---|---|---|---|
| 566,251 A | | 8/1896 | Tuttle | 239/654 |
| 867,806 A | | 10/1907 | Ditchfield | 239/515 |
| 3,112,771 A | | 12/1963 | Bringolf | 138/129 |
| 3,174,251 A | | 3/1965 | West | 43/148 |
| 3,347,469 A | | 10/1967 | Ross et al. | 239/434 |
| 3,428,093 A | | 2/1969 | Guiles | 138/132 |
| 3,881,653 A | | 5/1975 | Birckhead | 239/15 |
| 4,121,624 A | | 10/1978 | Chen | 138/122 |
| 4,303,104 A | | 12/1981 | Hegler et al. | 138/121 |
| 4,337,800 A | | 7/1982 | Carlson et al. | 138/122 |
| 4,420,019 A | | 12/1983 | Dillon | 138/129 |
| 4,435,460 A | | 3/1984 | Menzel | 428/129 |
| 4,487,227 A | * | 12/1984 | Meissner | 138/37 |
| 4,490,575 A | | 12/1984 | Kutnyak | 174/47 |
| 4,589,448 A | | 5/1986 | del Valle | 138/122 |
| 4,821,768 A | * | 4/1989 | Lett | 137/551 |
| 4,865,255 A | | 9/1989 | Luvisotto | 239/149 |
| 4,976,289 A | | 12/1990 | Umemori et al. | 138/122 |
| 5,020,943 A | * | 6/1991 | Filipelli | 406/195 |
| 5,174,653 A | * | 12/1992 | Halat et al. | 366/339 |
| 5,505,027 A | * | 4/1996 | Young | 52/169.5 |
| 5,829,649 A | | 11/1998 | Horton | 226/636 |
| 5,992,465 A | * | 11/1999 | Jansen | 138/37 |
| 6,206,050 B1 | | 3/2001 | Kelley et al. | 138/129 |
| 6,401,757 B1 | * | 6/2002 | Pentz et al. | 138/37 |

FOREIGN PATENT DOCUMENTS

| | | | |
|---|---|---|---|
| GB | 23326 | 12/1914 | 239/521 |
| GB | 224820 | 11/1924 | 239/521 |

* cited by examiner

*Primary Examiner*—Patrick Brinson
(74) *Attorney, Agent, or Firm*—Duane Morris LLP

(57) ABSTRACT

Dispensing equipment for dispensing blown loose-fill insulation. The equipment includes a flexible delivery conduit that conveys loose-fill insulation material from a source of such material and, possibly, an optional a rigid tubular wand connected to the distal end of the conduit. The equipment further includes structure projecting radially inwardly into the loose-fill insulation flow path of the delivery conduit and/or wand for mechanically separating the insulation material's fibers and particles prior to discharge from the delivery conduit or wand. The insulation material separating structure conditions or "opens" the insulation material in such a way that the material is discharged in a substantially uniform density stream of substantially uniformly distributed fibers and particles.

35 Claims, 3 Drawing Sheets

LOOSE-FILL INSULATION DISPENSING APPARATUS INCLUDING SPIKED CONDUIT LINER

CROSS-REFERENCE TO RELATED APPLICATIONS

The present application is related to U.S. patent application Ser. No. 09/817,429, entitled IMPROVEMENT TO HOSE USED TO INSTALL LOOSE FILL INSULATION, filed Apr. 30, 2001 as a divisional of U.S. patent application Ser. No. 09/282,409, filed Mar. 31, 1999, U.S. Pat. No. 6,206,050, and, U.S. patent application Ser. No. 09/845,889, now U.S. Pat. No. 6,336,474, entitled IMPROVEMENT TO HOSE USED TO INSTALL LOOSE FILL INSULATION, filed May 17, 2001 as a continuation-in-part of U.S. patent application Ser. No. 09/817,429.

FIELD OF THE INVENTION

The present invention relates in general to apparatus for dispensing blown, loose-fill insulation materials and in particular to apparatus for decreasing the density of such insulation as it is discharged from the apparatus.

BACKGROUND OF THE INVENTION

Because of cost-effectiveness, speed and ease of application, as well as thoroughness of coverage in both open and confined areas, the practice of using pneumatically delivered or "blown" loose-fill insulation materials, e.g. glass fiber, rock wool, mineral fiber wool, cellulose fibers, expanded mica, and the like, has become an increasingly popular method by which to install insulation in new and existing building constructions. The essential components of a typical blown loose-fill delivery system include a source of insulation material such as a hopper or the like, conduit means for conveying the material from the insulation source to the installation site, and a source of pressurized air such as a compressor, blower or the like, for generating a flow of pressurized air for entraining the fibrous and/or particulate loose-fill insulation material and delivering it from its source and through the conduit means for discharge at the installation site.

Loose-fill insulation blown into ceilings and outside wall cavities is very effective in reducing heat transfer in existing buildings. Exterior wall cavities of finished rooms may be filled with blown insulation through holes bored in exterior siding, or the like, without removing or cutting the interior wall surfacing materials. In addition, loose-fill blown insulation can be used in new construction, where insulative batts are often used.

Loose-fill insulation can provide a substantial advantage over batt-type insulation in that the loose-fill material readily assumes the actual shape of the interior cavity being filled, whereas the insulative batts are manufactured in a limited number of standard size widths, none of which will as closely match the actual dimensions of wall cavities or accommodate obstructions encountered in the field. Properly installed, loose-fill insulation essentially completely fills the wall cavity, conforming to the actual shape of the wall cavity, including obstructions, and provides, in that respect, effective resistance to heat transfer through the wall. Loose-fill insulation also lends itself to installation in ceilings, party walls and any other place where it is desired to resist heat transfer, as an alternative to batts, especially where there are obstructions such as, water, waste and gas lines, electrical conduits, heating and air conditioning ducts, etc.

In order to promote efficient use of energy required to heat and/or cool new buildings, many building codes require that new buildings be constructed to provide a certain minimum resistance to heat flow. To achieve this threshold, insulation is typically installed between one or more of a building's interior and exterior walls and possibly in superstructure and foundation areas such as crawl spaces, attics and basements. "R-value" refers to an insulation's thermal resistance or resistance to heat flow. The higher an insulation's R-value, the greater its thermal insulative capability. Existing building constructions can increase the R-value of their insulation by supplementing existing insulation with additional insulation.

The most influential factors for achieving a desired R-value when installing blown or pneumatically-delivered fibrous installation are the thickness and density of the material to be installed. In "open" areas such as attics, for example, insulation thickness or density is not normally of great concern. However, in confined areas such as the voids between interior and building walls the available insulation space may be quite limited. This physical constraint restricts installation of blown insulation beyond a certain thickness and thus may materially impact the available R-value for insulation present in such areas, especially if the insulation is installed at less than optimum consistency and density.

The insulation material used in conventional insulation blowing machines is typically in a relatively loose condition though usually packed under high compression in bags or sacks for shipment to the user. Upon being opened, these bags or sacks are typically manually emptied into a receiving hopper of a conventional insulation spraying or blowing machine. Once in the receiving hopper, the insulation material includes many relatively large compressed masses or clumps that may be difficult to feed through an air hose to a dispensing nozzle. And, even if the clumps are successfully dispensed they may produce an installed layer or volume of insulation material of inconsistent density and R-value. That is, the clumps themselves may have comparatively high R-values whereas the many void spaces between the clumps may have negligible R-values. Those of ordinary skill in the art of blown loose-fill insulation are aware that thermal performance of the installed material is optimized when its fibers and particles are dispensed and installed as uniformly distributed, finely separated fibers and particles rather than as clumps.

An advantage exists, therefore, for a blown loose-fill insulation dispensing apparatus that conditions the insulation material as it is discharged from the device such that the material is discharged in a substantially uniform density stream of separated fibers and/or particles.

SUMMARY OF THE INVENTION

The present invention provides apparatus for dispensing blown loose-fill insulation. The apparatus includes a flexible delivery conduit that conveys loose-fill insulation material from a source of such material and, possibly, an optional rigid tubular wand connected to the distal end of the conduit. According to certain preferred embodiments, the apparatus further comprises a substantially cylindrical member that may be removably or permanently disposed within either or both of the flexible delivery conduit and rigid tubular wand connected thereto. According to other preferred embodiments, the cylindrical member may be constructed as either a male or female hose coupling for joining first and second flexible loose-fill insulation material delivery conduits. The cylindrical member includes means projecting radially inwardly into the loose-fill insulation flow path of the delivery conduits or wand for mechanically separating the insulation material's fibers and particles prior to discharge from the discharge delivery conduit or wand. In so doing, the separating means conditions or "opens" the insulation material in such a way that the material is discharged in a substantially uniform density stream of substantially uniformly distributed fibers and particles.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments shown, by way of example only, in the accompanying drawings wherein.

DETAILED DESCRIPTION OF THE INVENTION

Figure 1:
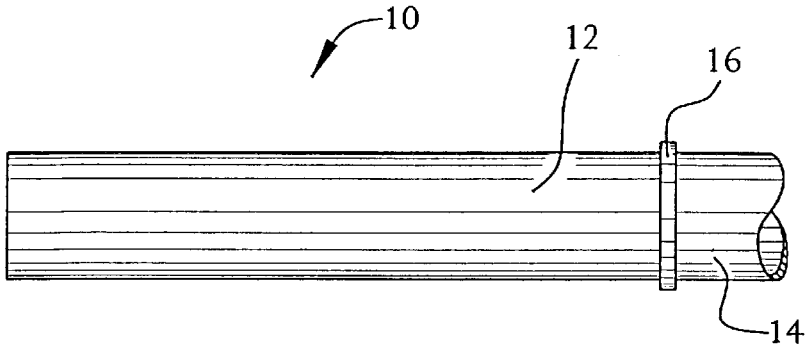
FIG. 1 (PRIOR ART)
FIG. 1 is a side view of a conventional loose-fill insulation dispensing apparatus.

Referring to the drawings wherein like references indicate like or similar elements throughout the several figures, there is shown in FIG. 1 the dispensing apparatus 10 of a conventional loose-fill insulation delivery system. The essential components of any loose-fill insulation delivery system include a source of insulation material such as glass fiber or the like, conduit means, a compressor, blower or the like, and dispensing means attached to or constituted by the distal end of the conduit means. The compressor or blower generates a flow of pressurized air for entraining the fibrous insulation material and delivering it from the insulation source through the conduit means to the dispensing means for discharge at the installation site. Accordingly, only those loose-fill insulation material delivery system components which form a part of the present invention will be described in detail herein.

Conventional loose-fill insulation dispensing apparatus 10 may comprise an optional lightweight, rigid, metal or plastic pipe or wand 12 of about 2 to about 4 inches in diameter, typically about 3 to about 4 inches in diameter and having smooth internal wall surfaces. Although it may be permanently affixed thereto, pipe 12 is normally releasably attached at its rearward end to the distal end of a flexible delivery conduit 14 via suitable means 116 such as adhesive tape, threading, clamp means, or the like. If present, pipe 12 may range in length from about the width of a user's palm, i.e., about 4 inches, up to about 8 feet whereby the pipe may be manually grasped and manipulated to dispense insulation to open areas such as attics and to confined and/or inaccessible areas such as, for example, the void spaces between the interior and exterior walls of a building. As is known, flexible delivery conduit 14 normally ranges from about 2.5 to about six inches in diameter and may be fabricated from smooth-walled or corrugated plastic, rubber or rubber-like tubing.

A typical, although not limitative, pneumatically delivered loose-fill insulation comprises macerated glass fiber whose individual fiber lengths may range from about 0.25 inches to about 2.0 inches and diameters may range from about 1.0 to 10.0 microns. The insulation may optionally include binders or other additives to enhance its cohesiveness, flowability, durability or other beneficial processing or performance characteristics. With or without binders, however, the density of such materials as presently deposited by conventional dispensing apparatus such as apparatus 10 shown in FIG. 1 is about 0.4 to about 0.7 $lb/ft^3$. Because presently available loose-fill insulation delivery system dispensing apparatus have no structure for mechanically separating or "opening" the insulation as it passes through the flexible delivery body member and optional wand, loose-fill insulation material is frequently dispensed as a non-uniform flow of compressed masses or clumps which, as discussed above, does not optimize the insulative capability of the installed insulation material. This is especially true when binders and other additives are present in the insulation.

Figure 2:
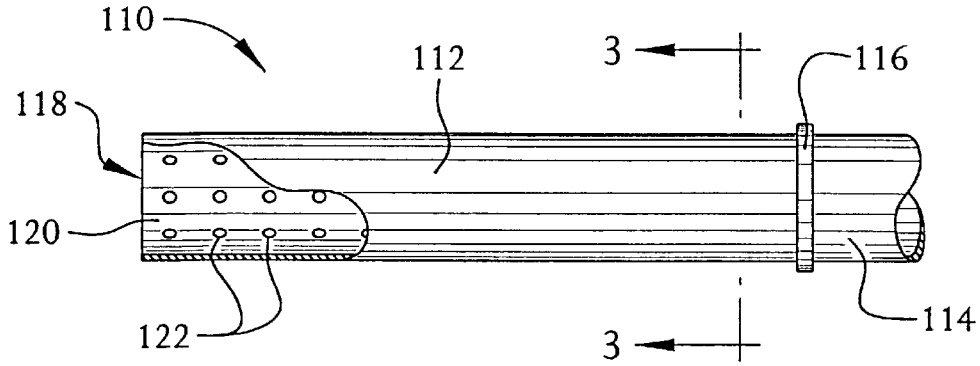
FIG. 2 is a partially cut-away side view of a first embodiment of a loose-fill insulation dispensing apparatus constructed in accordance with the present invention.
Figure 3:
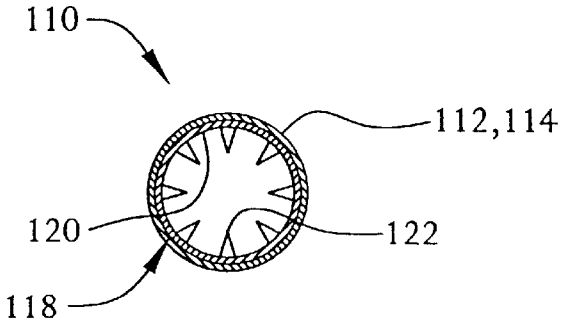
FIG. 3 is a cross-sectional view taken along line 3—3 of FIG. 2.

FIGS. 2 and 3 illustrate a first embodiment of a loose-fill insulation delivery system dispensing apparatus 110 according to the present invention. Similar to dispensing apparatus 10 of FIG. 1, apparatus 110 may include an optional lightweight, rigid, metal or plastic pipe or wand 112. Although it may be permanently affixed thereto, pipe 112 is normally releasably attached at its rearward end to the distal end of a flexible delivery conduit 114 via suitable means 116 such as adhesive tape, threading, clamp means, or the like.

Apparatus 110 includes separating member 118 (shown in greater detail in FIG. 4) for mechanically separating the insulation material prior to discharge from the delivery conduit 114 or wand 112. Separating member 118 may comprise any means for establishing a relieved, textured or otherwise rough surface on the interior wall of the delivery conduit and/or wand (if present). More particularly, separating member 118 preferably comprises a rigid plastic or metal tubular body member 120 having projection means 122 in the form of spiked elements or portions that project radially inwardly into the loose-fill insulation flow path of the delivery conduit 114 and/or wand 112. According to the present invention, projection means 112 may assume any suitable shape, pattern or number depending on the type of loose-fill insulation chosen for installation. In addition, projection means 112 may be fabricated from the same or different material than body member 120 and may be manufactured concurrently with or after the body member. For instance, if body member 120 is formed from a cast metal or molded plastic, projection means 122 may be formed integrally and concurrently with the body member. If made of sheet metal, projection means 122 may be punched or stamped out of the metal sheet by suitable apparatus and methods known in the art after manufacturer of the sheet. Thereafter, the stamped sheet may be formed into a cylinder with the projection means 122 being disposed on the interior of the cylinder. Alternatively, projection means 122, may be nails, tacks, screws or other simple fastening means that may be installed through the outer wall of a prefabricated body member 120.

The extent to which projection means 122 project into the loose-fill insulation flow path should not be so great as to detrimentally obstruct or clog the flow path during operation of apparatus 110. However, it should be sufficient to condition or "open" the insulation material in such a way that the insulation material is discharged in a substantially uniform density stream of fibers and/or particles.

The dimensions and accessibility of the building spaces to be insulated, coupled with the loose-fill insulation chosen for installation, dictate the appropriate diameters of delivery conduit 114 and wand 112 and whether a wand is desirable or necessary. It will be understood, therefore, that the dimensions, arrangement and other structural characteristics of projection means 122 may vary considerably. For currently available loose-fill glass fiber insulation materials, and for ranges of the diameters for the delivery conduit and wand mentioned above, a suitable separating member 118 is preferably constructed as a rigid metal or plastic body member 120 having a length of from about 18 to about 36 inches with projection means 122 that project into the loose-fill insulation flow path should a distance of about 0.25 to about 0.5 inches.

The outer diameter of body member 120 should be selected that separating member 180 is in a firm friction fit with the interior wall of the delivery conduit 114 and/or wand 112 within which it is received in order to prevent dislodgement of the separating means during operation of apparatus 110. If, however, additional anchorage is desired or necessary, the installer may fixedly secure separating member 118 to delivery conduit 114 and/or wand 112 with any suitable fastening means including screws, rivets, staples, ties or other mechanical fasteners, adhesives, or combinations thereof. It is generally desirable for manipulability and safety purposes that all or substantially all of separating member 118 be disposed within the delivery conduit 114 and/or wand 112.

Moreover, although shown as being positioned adjacent the discharge or outlet end of delivery conduit 114 and/or in wand 112 (if present), it has been discovered that successful results also may be achieved by placing separating member 118 adjacent the opposite or intake end thereof that is connectable to a source of loose-fill insulation material as described above.

Figure 4:
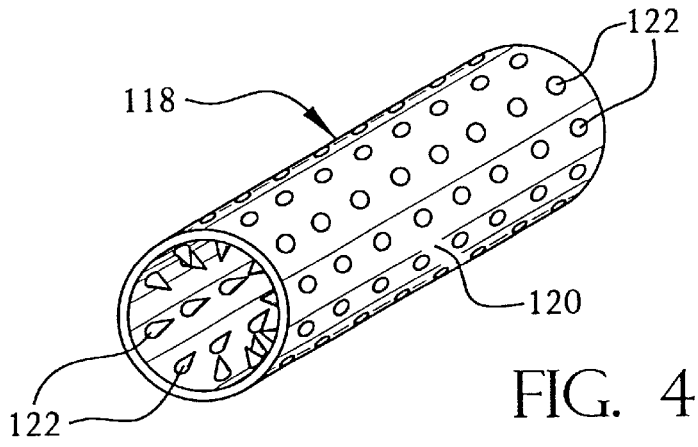
FIG. 4 is a perspective view of a first embodiment of a loose-fill insulation separating means depicted in FIGS. 2 and 3.
Figure 5:
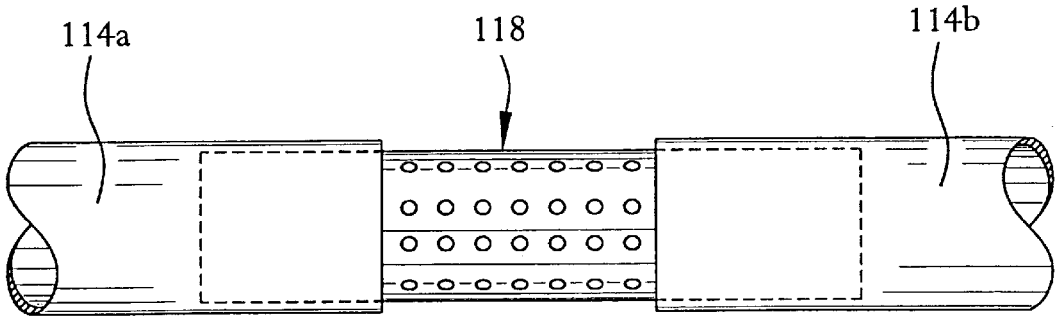
FIG. 5 is a side view of the loose-fill insulation separating means of FIG. 4 deployed as a male hose coupling for joining first and second flexible loose-fill insulation material delivery conduits.

FIG. 5 is a side view of the loose-fill insulation separating member 118 of FIGS. 2–4 deployed as a male hose coupling for connecting opposed ends of first and second flexible loose-fill insulation material delivery conduit portions 114*a* and 114*b*. As illustrated, opposite ends of separating member 118 are preferably firmly received in the opposed ends of the conduit portions 114*a*, 114*b*. if necessary, unillustrated and conventional hose clamps may be used to tightly secure the opposed ends of conduit portions 114*a*,114*b* to opposite ends of separating member 118. So disposed, separating member 118 may be used to separate the particles and/or fibers of the loose-fill insulation at an intermediate point in the flexible delivery conduit tubing if such is desired or necessary. It also provides the practical advantage of creating a single flexible delivery conduit having the combined length of delivery conduit portions 114*a* and 114*b* which would be useful in circumstances where neither conduit portion 114*a* nor conduit portion 114*b*, with or without optional wand 112, is sufficiently long to reach a desired insulation installation site.

Figure 6:
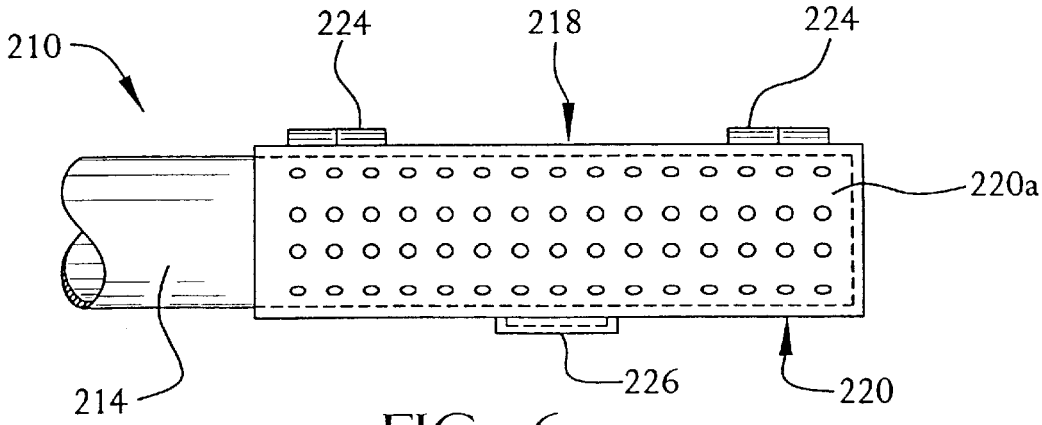
FIG. 6 is a side view of a further embodiment of a loose-fill insulation dispensing apparatus constructed in accordance with the present invention.

FIG. 6 is a side view of a further embodiment of a loose-fill insulation dispensing apparatus constructed in accordance with the present invention and identified generally by reference numeral 210. Apparatus 210 comprises a flexible loose-fill insulation delivery conduit 214 and a loose fill insulation separating member 218 attached adjacent an end, either the intake or discharge end, of conduit 214. like separating member 118 described above, separating member 218 comprises a rigid tubular body member 220 fitted with a plurality of radially inwardly directed projection means 222 disposed in a desired number and array about the interior thereof. As shown most clearly in FIG. 7, unlike the continuous cylindrical tubular body member 120 of separating member 118, however, body member 220 is preferably constructed as a plurality, most preferably two, of partially cylindrical body portions 220*a* and 220*b*. Body portions 220*a*, 220*b* are pivotally connected together by one or more hinge means 224 and are releasably closable about delivery conduit 214 by one or more clasps, latches or similar closure means 226. As is known in the art, hinge means 224 and closure means 226 may be attached to body portions 220*a* and 220*b* after fabrication of the body members. Alternatively, the hinge means and closure means may be formed concurrently with the body portions, e.g., the body portions 220*a*, 220*b*, hinge means 224 and closure means 226 may be formed simultaneously as components of a continuous, one-piece molded plastic object by any of various conventional plastic molding techniques.

Regardless of the mode of manufacture of separating member 218, the inner diameter of tubular body member 220 should be the same or essentially the same as the outer diameter of delivery conduit 212. Thus, when body portions 220*a* and 220*b* are enclosed about the delivery conduit 214 it is preferred that they be in continuous and firm contact therewith. Moreover, projection means 222 should be sufficiently sharp to puncture and fully penetrate delivery conduit 214 when body member 220 is in its closed state. Additionally, it is essential that projection means 222 be sufficiently long to project into the loose-fill insulation flow path of delivery conduit 214 to separate the loose-fill insulation material conveyed thereby yet not so long as to cause obstruct or clog flow of the insulation material.

Figure 7:
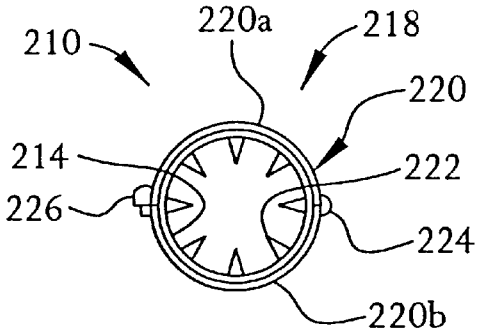
FIG. 7 is an end view of the apparatus shown in FIG. 6.
Figure 8:
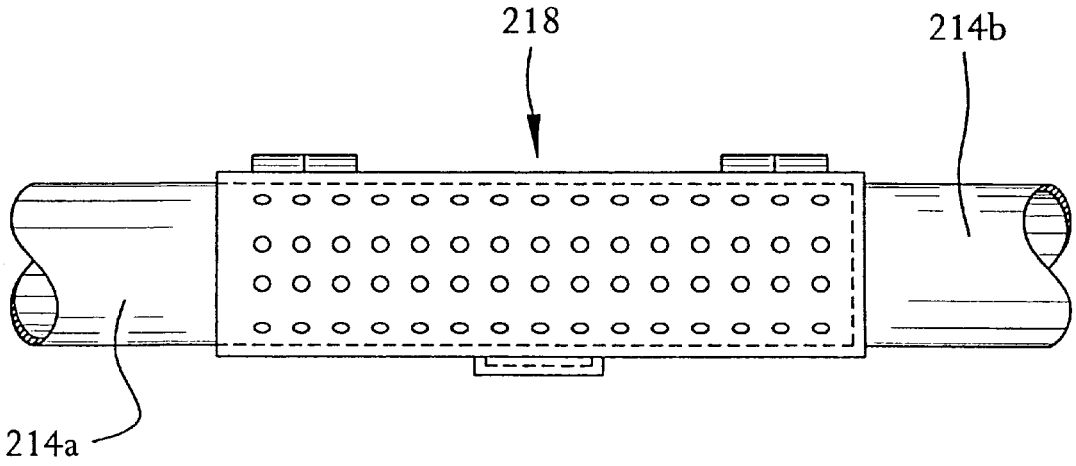
FIG. 8 is a side view of the loose-fill insulation separating means of FIG. 6 deployed as a female hose coupling for joining first and second flexible loose-fill insulation material delivery conduits.

FIG. 8 is a side view of the loose-fill insulation separating member 218 of FIGS. 6 and 7 deployed as a female hose coupling for connecting opposed ends of first and second flexible loose-fill insulation material delivery conduit portions 214*a* and 214*b*. As illustrated, opposite ends of separating member 218 receive the opposed ends of the conduit portions 214*a*, 214*b*. Similar to separating member 118 of FIG. 5, separating member 218 may be used to separate the particles and/or fibers of the loose-fill insulation at an intermediate point in the flexible delivery conduit tubing if such is desired or necessary. Likewise, it also provides the practical advantage of creating a single flexible delivery conduit having the combined length of delivery conduit portions 214*a* and 214*b* which would be useful in circumstances where neither conduit portion 214*a* nor conduit portion 214*b*, with or without an optional wand, is sufficiently long to reach a desired insulation installation site.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. Apparatus for dispensing loose-fill insulation material comprising:

a flexible delivery conduit for conveying loose-fill insulation material from a source of loose-fill insulation material and for dispensing loose-fill insulation material at a desired location; and a separating member carried by said conduit for separating loose-fill insulation material dispensed by said conduit, said separating member having a plurality of projections extending therefrom for contacting and separating said loose-fill insulation.

2. The apparatus of claim 1 wherein said separating member is disposed in said conduit.

3. The apparatus of claim 1 wherein said separating member is disposed at an intake end of said conduit.

4. The apparatus of claim 1 wherein said separating member is disposed adjacent a discharge end of said conduit.

5. The apparatus of claim 1 wherein said conduit comprises first and second conduit portions having opposed ends, and wherein said separating member further functions as a hose coupling for connecting said opposed ends.

6. The apparatus of claim 5 wherein said separating member functions as a male hose coupling received within said opposed ends.

7. The apparatus of claim 5 wherein said separating member functions as a female hose coupling receiving said opposed ends.

8. The apparatus of claim 1 wherein said separating member establishes a rough surface on the interior wall of said conduit.

9. The apparatus of claim 8 wherein said separating member includes spiked portions that project radially inwardly into a loose-fill insulation flow path of said conduit.

10. The apparatus of claim 1 wherein said separating member comprises a tubular body member and wherein said spiked portions project radially inwardly from said body member.

11. The apparatus of claim 10 wherein said tubular body member comprises a plurality of hingedly connected and releasably closable partially cylindrical body portions, said body portions being operable to releasably enclose said conduit.

12. The apparatus of claim 1 wherein said separating member is from about 18 to about 36 inches in length.

13. Apparatus for dispensing loose-fill insulation material comprising:

a flexible delivery conduit for conveying loose-fill insulation material from a source of loose-fill insulation material;

a rigid pipe connected to an end of said conduit for dispensing loose-fill insulation material at a desired location; and a separating member carried by at least one of said conduit and said pipe for separating loose-fill insulation material dispensed by said pipe, said separating member including a plurality of spiked projections for contacting and separating clumps in said loose-fill insulation.

14. The apparatus of claim 13 wherein said separating member is disposed in said conduit.

15. The apparatus of claim 13 wherein said separating member is disposed at an intake end of said conduit.

16. The apparatus of claim 13 wherein said separating member is disposed adjacent a discharge end of said conduit.

17. The apparatus of claim 13 wherein said conduit comprises first and second conduit portions having opposed ends, and wherein said separating member further functions as a hose coupling for connecting said opposed ends.

18. The apparatus of claim 17 wherein said separating member functions as a male hose coupling received within said opposed ends.

19. The apparatus of claim 17 wherein said separating member functions as a female hose coupling receiving said opposed ends.

20. The apparatus of claim 13 wherein said separating member establishes a rough surface on the interior wall of at least one of said conduit and said pipe.

21. The apparatus of claim 13 wherein said separating means comprises a tubular body member and wherein said spiked projections are positioned radially inwardly from said body member.

22. The apparatus of claim 21 wherein said tubular body member comprises a plurality of hingedly connected and releasably closable partially cylindrical body portions, said body portions being operable to releasably enclose said conduit.

23. The apparatus of claim 13 wherein said separating member is from about 18 to about 36 inches in length.

24. A loose-fill insulation material separating device for use with at least one of a flexible delivery conduit for conveying loose-fill insulation material from a source of loose-fill insulation material and a rigid pipe connectable to an end of the flexible delivery conduit for dispensing loose-fill insulation material at a desired location, said device comprising:

a rigid tubular body member connectable to at least one of the flexible delivery conduit and the rigid pipe; and a separating member carried by said body member, said separating member having a rough surface on the interior-facing wall thereof.

25. The device of claim 24 wherein the device is disposable at an intake end of the conduit.

26. The device of claim 24 wherein the device is disposable adjacent a discharge end of the conduit.

27. The device of claim 24 wherein said rough surface includes spiked portions that project radially inwardly into a loose-fill insulation flow path of at least one of the conduit and the pipe.

28. The device of claim 27 wherein said separating member comprises a tubular body member and wherein said spiked portions project radially inwardly from said body member.

29. The device of claim 24 wherein said tubular body member comprises a plurality of hingedly connected and releasably closable partially cylindrical body portions, said body portions being operable to releasably enclose said conduit.

30. The device of claim 24 wherein said conduit comprises first and second conduit portions having opposed ends, and wherein said separating member further functions as a hose coupling for connecting said opposed ends.

31. The device of claim 30 wherein said separating member functions as a male hose coupling received within said opposed ends.

32. The device of claim 30 wherein said separating member functions as a female hose coupling receiving said opposed ends.

33. The device of claim 24 wherein the device is from about 18 to about 36 inches in length.

34. An apparatus for dispensing loose-fill insulation material comprising:

a flexible delivery conduit for conveying loose-fill insulation material from a source of loose-fill insulation material and for dispensing loose-fill insulation material at a desired location; and a separation member comprising a rough surface or a plurality of projections for assisting in breaking up clumps in said loose-fill insulation carried by said conduit.

35. The apparatus of claim 34 wherein the separation member comprises a sheath disposed within the conduit with spiked portions that project radially inwardly into a loose-fill insulation flow path of said conduit.

* * * * *